US005660648A

United States Patent [19]

Takada et al.

[11] Patent Number: 5,660,648

[45] Date of Patent: Aug. 26, 1997

[54] MICROALLOYED STEEL FOR HOT FORGING FREE OF SUBSEQUENT QUENCHING AND TEMPERING, PROCESS FOR PRODUCING HOT FORGING, AND A HOT FORGING

[75] Inventors: Hiromasa Takada; Yoshiro Koyasu, both of Muroran; Motohide Mori; Masami Suzuki, both of Okazaki, all of Japan

[73] Assignee: Nippon Steel Corporation, Tokyo, Japan

[21] Appl. No.: 347,360

[22] PCT Filed: Apr. 5, 1994

[86] PCT No.: PCT/JP94/00568

§ 371 Date: Jan. 5, 1995

§ 102(e) Date: Jan. 5, 1995

[87] PCT Pub. No.: WO94/23085

PCT Pub. Date: Oct. 13, 1994

[30] Foreign Application Priority Data

Apr. 5, 1993 [JP] Japan ..... 5-078091

[51] Int. Cl.$^6$ ..... C22C 38/24; C21D 8/00

[52] U.S. Cl. ..... 148/333; 148/649; 148/653; 148/654; 148/328

[58] Field of Search ..... 148/328, 333, 148/649, 653, 654; 420/118

[56] References Cited

U.S. PATENT DOCUMENTS 4,409,026 10/1983 Yamada et al. ..... 148/333
5,282,906 2/1994 Heitmann et al. ..... 148/333

FOREIGN PATENT DOCUMENTS 63-166949 7/1988 Japan .
4285118 10/1992 Japan ..... 148/649

*Primary Examiner*—Deborah Yee
*Attorney, Agent, or Firm*—Kenyon & Kenyon

[57] ABSTRACT

The present invention provides a steel material for a microalloyed part having a high strength in a hot worked state. A microalloyed steel for a high strength hot forging comprising specified amounts of C, Si, Mn, Cr, S, V and N, and Al and/or Ti, having a carbon equivalent in a definite range, and exhibiting a bainite transformation starting point in a definite range. A microalloyed steel for a high strength hot forging comprising specified amounts of C, Si, Mn, Cr, S, V, N and Ca, and Al and/or Ti, having a carbon equivalent in a definite range, and exhibiting a bainite transformation starting point in a definite range. Said steel material has a tensile strength of at least 900 MPa when it is in a hot forged, and non-quenched and tempered state. Automobile parts can be made small and light by the use of the steel of the invention.

9 Claims, No Drawings

MICROALLOYED STEEL FOR HOT FORGING FREE OF SUBSEQUENT QUENCHING AND TEMPERING, PROCESS FOR PRODUCING HOT FORGING, AND A HOT FORGING

TECHNICAL FIELD OF THE INVENTION

Among steel materials which are worked to produce machine parts such as automobile parts and industrial machine parts, the present invention relates to a microalloyed steel for hot forging from which machine parts are prepared by working, for example, hot forging or hot rolling (as-hot worked in some cases), and subsequently by aging in some cases, a process for producing a microalloyed hot forging using said steel, and a microalloyed hot forging.

PRIOR ART

Many automobile parts and industrial machine parts are prepared by hot working a steel bar, and quenching and tempering the worked products to refine the structure and enhance the strength and toughness, and the parts thus obtained are used. However, machine parts which are prepared without quenching and tempering treatment to reduce the cost, namely parts prepared from microalloyed steel for hot forging (referred to as a microalloyed steel hereinafter) have become increasing common in recent years. Reduced fuel consumption of automobiles has been required in recent years, to protect the global environment. One effective method for reducing fuel consumption is decreasing the weight of vehicles. Accordingly, improving the strength of automobile parts and thus making the parts small and light are important goals.

To particularly strengthen steel parts, the steel parts must have a bainite or martensite structure. Various kinds of inventions have been disclosed relating to microalloyed steels of bainite structures. Japanese Patent Kokai Publication NO. 1-177339 discloses a microalloyed steel which can be used in an as-air cooled state after hot forging. Since bainitic steel has a disadvantage that it has a low yield strength, the steel has been conventionally toughened by further aging. For example, Japanese Patent Kokai Publication No. 2-25516 discloses a method comprising aging a bainitic steel at a temperature of 200° to 600° C. after forging to toughen the steel.

However, demand for automobiles of low fuel consumption has become increasingly strong, and further strengthened and toughened parts therefor are required.

SUMMARY OF THE INVENTION

As a result of investigating the improvement of the tensile strength of conventional steel parts used as driving-related parts of automobiles, the present inventors have discovered that a microalloyed steel with a bainite structure which mostly has heretofore had a tensile strength of approximately up to 1,000 MPa can be relatively easily improved to have a tensile strength of at least 1,000 MPa by increasing alloying elements therein, and thus they have achieved the present invention.

Furthermore, it has been difficult to impart a toughness necessary for driving-related parts of automobiles as well as a tensile strength of at least 1,000 MPa to the bainitic microalloyed steel. Still furthermore, the bainitic microalloyed steel has a problem that it has a low yield ratio.

An object of the present invention is to provide a steel material for a hot forged microalloyed bainitic steel parts which has in an as-hot forged state a tensile strength exceeding 1,000 MPa and a high toughness and realizes a high yield strength, namely a microalloyed steel for hot forging, a process for producing a microalloyed hot forging and the hot forging.

The subject matter of the present invention is as described below.

(1) A microalloyed steel for hot forging comprising, in terms of percentage by weight, from 0.15 to 0.40% of C, from 0.90 to 3.00% of Si, from 1.20 to 3.00% of Mn, from 0.10 to 0.50% of Cr, from 0.03 to 0.10% of S, from 0.05 to 0.50% of V, from 0.0080 to 0.0200% of N and the balance Fe and unavoidable impurities, having a carbon equivalent (Ceq.) represented by the formula $$\text{Ceq. }(\%)=C+0.10\ (\%Si)+0.18\ (\%Mn)+0.21\ (\%Cr)+0.328\ (\%V)$$

of at least 0.82%, and exhibiting a bainite transformation starting point Bs represented by the formula $$Bs\ (K)=1152-618\ (\%C)-25\ (\%Si)-76\ (\%Mn)-55\ (\%Cr)-127\ (\%V)$$

of up to 810K.

(2) A microalloyed steel for hot forging according to (1), wherein said microalloyed steel further comprises one or two selected from the group of from 0.005 to 0.050% of Al and from 0.002 to 0.050% of Ti.

(3) A microalloyed steel for hot forging further comprising one or two selected from the group of from 0.05 to 1.00% of Mo and from 0.01 to 0.50% of Nb in addition to the components according to (1) and the balance Fe and unavoidable impurities, having a carbon equivalent (Ceq.) represented by the formula $$\text{Ceq. }(\%)=C+0.10\ (\%Si)+0.18\ (\%Mn)+0.21\ (\%Cr)+0.155\ (\%Mo)^{1/2}+0.328\ (\%V+\%Nb)$$

of at least 0.82%, and exhibiting a bainite transformation starting point Bs represented by the formula $$BS\ (K)=1152-618\ (\%C)-25\ (\%Si)-76\ (\%Mn)-55\ (\%Cr)-69\ (\%Mo)-127\ (\%V+\%Nb)$$

of up to 810K.

(4) The microalloyed steel for hot forging according to (3), wherein said steel further comprises one or two selected from the group of from 0.005 to 0.050% of Al and from 0.002 to 0.050% of Ti.

(5) A process for producing a microalloyed steel hot forging comprising the steps of;

working a microalloyed steel for hot forging which comprises, in terms of percentage by weight, from 0.15 to 0.40% of C, from 0.90 to 3.00% of Si, from 1.20 to 3.00% of Mn, from 0.10 to 0.50% of Cr, from 0.03 to 0.10% of S, from 0.05 to 0.50% of V, from 0.0080 to 0.0200% of N and the balance Fe and unavoidable impurities, which has a carbon equivalent (Ceq.) represented by the formula $$\text{Ceq. }(\%)=C+0.10\ (\%Si)+0.18\ (\%Mn)+0.21\ (\%Cr)+0.328\ (\%V).$$

of at least 0.82%, and which exhibits a bainite transformation starting point Bs represented by the formula $$Bs\ (K)=1152-618\ (\%C)-25\ (\%Si)-76\ (\%Mn)-55\ (\%Cr)-127\ (\%V)$$

of 1 up to 810K, and working said microalloyed steel at a temperature of at least 1270K, allowing the worked product to cool, or, after working at a temperature of at least 1270K and allowing the worked product to cool, further aging the cooled product at a temperature of 450 to 900K.

(6) A process for producing a microalloyed steel hot forging comprising the steps of;

working a microalloyed steel for hot forging according to (1) which further comprises one or two selected from the group of from 0.005 to 0.050% of Al and from 0.002 to 0.050% of Ti, at a temperature of at least 1270K and allowing the worked product to cool, or, after working said microalloyed steel at a temperature of at least 1270K and allowing the worked product to cool, further aging the cooled product at a temperature of 450 to 900K.

(7) A process for producing a microalloyed hot forging comprising the steps of;

working a microalloyed steel for hot forging which further comprises one or two selected from the group of from 0.05 to 1.00% of Mo and from 0.01 to 0.50% of Nb in addition to the components according to (5) and the balance Fe and unavoidable impurities, which has a carbon equivalent (Ceq.) represented by the formula $$Ceq.\ (\%)=C+0.10\ (\%Si)+0.18\ (\%Mn)+0.21\ (\%Cr)+0.155\ (\%Mo)^{1/2}+0.328\ (\%V+\%Nb)$$

of at least 0.82%, and which exhibits a bainite transformation starting point Bs represented by the formula $$Bs\ (K)=1152-618\ (\%C)-25\ (\%Si)-76\ (\%Mn)-55\ (\%Cr)-69\ (\%Mo)-127\ (\%V+\%Nb)$$

of up to 810K, and working said microalloyed steel at a temperature of at least 1270K, allowing the worked product to cool, or, after working at a temperature of at least 1270K and allowing the worked product to cool, further aging the cooled product at a temperature of 450 to 900K.

(8) A process for producing a microalloyed hot forging comprising the steps of;

working a microalloyed steel for hot forging which further comprises one or two selected from the group of from 0.005 to 0.050% of Al and from 0.002 to 0.050% of Ti in addition to the components according to (7), at a temperature of at least 1270K and allowing the worked product to cool, or, after working said microalloyed steel at a temperature of at least 1270K and allowing the worked product to cool, further aging the cooled product at a temperature of 450 to 900K.

(9) A microalloyed hot forging comprising the components according to (1), (2), (3), or (4), having a bainite structure in a volume of at least 80%, and exhibiting a tensile strength of at least 1,000 MPa.

BEST MODE FOR CARRYING OUT THE INVENTION

Firstly, the present inventors have investigated a method for achieving a high yield ratio. Though bainitic steel is known as an isothermal transformation structure, a bainitic steel in a hot forged, and non-quenched and tempered state often contains in its structure not only bainite but also retained austenite and martensite. The structure is formed as described below. Since the period of time for the steel subsequent to hot forging to pass through the bainite transformation temperature range during air cooling is not sufficient, the austenite which has not transformed is retained to a low temperature, and part of the austenite is transformed to martensite at a lower temperature. The low yield ratio of the bainitic steel is caused by a large amount of the mild retained austenite.

The steel can be effectively made to have a high yield ratio by decomposing the retained austenite structure through aging and thus changing the structure into a tough structure. The present invention has succeeded in making steel having both a high toughness and a high yield ratio particularly by refining the structure of the steel and aging the steel subsequent to hot forging in combination.

As a result of variously carrying out investigations of toughening a bainitic steel, the present inventors have discovered that the bainitic steel can be effectively toughened by a combination of refining a hot forged bainite lath structure through adjusting the components of the steel so that the steel has a low bainite transformation starting temperature (Bs) and adding a relatively large amount of Si. Increasing the contents of Mn, V and Mo while the content of Cr is made the minimum value that is within the guaranteed content has been effective in adjusting Bs of the steel to a low value. Moreover, it has become evident that the fracture facet of the steel are refined at the time of steel fracture by preventing the prior austenite structure from coarsening, and as a result the toughness is improved. The prior austenite structure can be prevented from coarsening by the pinning effect of a carbonitride or MnS.

Though aging a bainitic steel is effective in making the steel have a high toughness as well as a high yield ratio, there is a limitation on the toughness the steel can attain even when the steel is aged most suitably in cases where the hot forged structure of the steel is coarse. It has been difficult to make bainitic steel which has a tensile strength of at least 1,000 MPa have an impact value comparable to that of a conventional quenched and tempered steel.

A combination of refining the bainite lath structure, adding a relatively large amount of Si and aging the steel is a method for giving the highest toughness to the steel.

Reasons for restricting the construction of the present invention will be explained below.

C: C is an element for strengthening the steel. When the content of C is less than 0.15%, a large amount of alloying elements become necessary for realizing a tensile strength of 1,000 MPa. As a result, the deformation resistance of the steel becomes large during hot forging, and the life of the forging die becomes short. When the C content exceeds 0.40%, the toughness is lowered.

Si: Si is a solution strengthening element, and acts to refine the retained austenite structure and improve the strength and toughness of the steel. Though at least 0.90% of the Si content is required to improve the toughness of the steel, the machinability is lowered when Si is added in an amount exceeding 3.00%.

Mn:-Mn is effective in enhancing the hardenability of the steel, making the bainite structure (as-forged and as-cooled) a refined lower bainite structure, and enhancing the strength and toughness thereof. A Mn content of less than 1.20% is insufficient in toughening the steel. A Mn content exceeding 3.00% lowers the toughness thereof.

Cr: Cr is the same as Mn and Mo in that it is an element effective in refining the hot forged and cooled bainite structure of the steel. However, since increasing the contents of Mn, V and Mo is more effective than increasing the content of Cr in lowering the bainite transformation starting temperature Bs and refining the structure thereof, the content of Cr is defined to be up to 0.50%. Furthermore, the lower limit of the Cr content is defined to be 0.10% which content can be easily guaranteed by the capacity of the process for producing the steel.

S: S forms MnS in the steel which prevents prior austenite grains from coarsening, makes the bainite lath cells small, and improves the toughness of the steel. Though a content of S of at least 0.03% is required to improve the toughness thereof, the addition of S in a content exceeding 0.10% deteriorates the toughness thereof. Although S is also essential to the improvement of the machinability of the steel, the addition of any of the following elements may exert the same effect on improving the machinability as the addition of S: from 0.005 to 0.50% of Pb, from 0.010 to 0.50% of Bi, from 0.001 to 0.20% of Te and from 0.010 to 0.50% of Se. When importance is attached to the machinability of the steel in cutting the steel using a cemented carbide tool, the addition of Ca in an amount of 0.0004 to 0.0050% is effective.

V: V lowers the bainite transformation temperature of the steel during forging, refines the as-forged and as-cooled bainite structure and enhances the toughness thereof, and precipitates when the steel is allowed to cool after forging to strengthen the steel. Moreover, V as-dissolved in the steel precipitates at the time of aging to further strengthen it. The addition of V in an amount of at least 0.05% is required to exert such effects as mentioned above. However, the upper limit of the addition amount of V is defined to be 0.50% to restrain the rise in the cost of the steel.

N: N forms nitrides with Al and Ti, which nitrides prevent the austenite structure of the steel from coarsening during hot forging, and enhances the toughness thereof. The content of N is required to be at least 0.008%. However, even when N is added in an amount exceeding 0.0200%, the effect is saturated.

Mo: Mo is the same as V in refining the structure and enhancing the toughness of the steel. The steel containing Mo precipitates Mo carbide to be strengthened when the steel is aged after hot forging. The addition of Mo in an amount of at least 0.05% is required when the steel is expected to have a high toughness. Since the addition thereof in a large amount increases the cost of the steel, the added amount is restricted to up to 1.00%.

Nb: Nb prevents as a nitride the austenite structure of the steel from coarsening. Nb in a dissolved state is the same as V and Mo in refining the bainite structure and enhancing the strength and toughness of the steel. Moreover, Nb dissolved in the steel precipitates during aging, and acts to further strengthen the steel. Nb is required to be added in an amount of at least 0.01% to exert such effects as mentioned above. However, when the added amount exceeds 0.50%, the toughness thereof is lowered.

Al and Ti are precipitated and dispersed in the steel as carbonitrides which prevent the austenite structure from coarsening and particularly enhance the toughness during forging and reheating. The amounts of Al and Ti necessary for preventing the austenite structure from coarsening are at least 0.005% and 0.002%, respectively. However, when Al and Ti are added in large amounts, they form coarsened precipitates, which embrittle the steel. Accordingly, the upper limits of the added amounts of Al and Ti are defined to be 0.050% and 0.050%, respectively.

The present inventors have taken hot forging steels into consideration, and investigated the tensile characteristics, the structure and the bainite transformation starting point (Bs) of steels having been heated to high temperature and cooled, for the purpose of adjusting the tensile strength and Bs of steels in a hot forged and as-air cooled state, and in a tempered state. Sample steels used in the investigation had the following compositions: from 0.1 to 0.5% of C, from 0.1 to 3.0% of Si, from 0.5 to 3.5% of Mn, from 0.2 to 3.0% of Cr, from 0.05 to 0.25% of V, from 0.05 to 0.25% of Nb, from 0 to 2.5% of Mo, from 0 to 0.05% of Al and from 0 to 0.05% of Ti, and have been of 40 class. The sample steels were heated at 1500K for 300 sec, and cooled at a rate of 1.0K/sec, and tested.

The data thus obtained was subjected to multiple regression analysis in which the tensile strength was taken as a dependent variable and the amounts of the elements as independent variables. The carbon equivalent Ceq. and the relation between Ceq. and the tensile strength TS thus obtained are as follows:

$$\text{Ceq. }(\%)=C+0.10\,(\%Si)+0.18\,(\%Mn)+0.21\,(\%Cr)+0.155\,(\%Mo)^{1/2}+0.328\,(\%V+\%Nb)$$

$$TS\ (MPa)=1046\times Ceq.+144$$

When a steel of the invention is hot forged and then allowed to cool to have Ceq. of at least 0.82%, the steel can have a tensile strength of at least 1,000 MPa. The steel of the invention then has a bainite single phase or a bainite structure containing to some extent ferrite, or martensite and austenite.

Furthermore, the data was subjected to multiple regression analysis in which Bs was taken as a dependent variable and the amounts of the elements as independent variables. As a result, Bs can be represented as follows:

$$Bs\ (K)=1152-618\,(\%C)-25\,(\%Si)-76\,(\%Mn)-55\,(\%Cr)-69\,(\%Mo)-127\,(\%V+\%Nb)$$

When the steel has Bs of up to 810K, the bainite structure is refined, and the toughness of the steel is improved. A procedure effective in lowering Bs is to make the Cr content minimum within the guaranteed range thereof, and increase the contents of Mn, Mo and V.

When the steel of the present invention is aged after hot forging, the yield strength of the steel can be enhanced through decomposing a mild retained austenite contained in the bainitic steel and tempering martensite. The steel is expected to be efficiently influenced by such aging when it is aged at a temperature of at least 450K. When the aging temperature is less than 450K, the yield strength of the steel cannot be enhanced or aging the steel over a long period of time is required. However, when the aging temperature exceeds 900K, the tensile strength of the steel is lowered. Though the tensile strength and yield strength of the steel subsequent to aging vary depending on the amounts of age hardening elements and the aging temperature, the addition of Mo, V and Nb which are age hardening elements can prevent the steel from suffering a decrease in its tensile strength when a relatively high aging temperature is adopted.

A working temperature of at least 1270K is required when working the steel to make the steel have an austenite single phase and lower the the thermal deformation resistance so that the life of the forging die is extended to a practical length. Moreover, the steel of the present invention has a structure mainly formed with a bainite structure and a tensile strength of at least 1,000 MPa in a cooled state without specifically cooling after working, so long as the steel is in the form of an automobile part having an ordinary size.

The steel part of the present invention according to claim 9 has a high strength and a high toughness when it has as a consequence a bainite structure in a volume amount of at least 80%. When the steel part has a bainite structure in an amount of less than 80% as a result of the cooling conditions, it may sometimes exhibit deteriorated mechanical properties due to other structures in the structure mixture.

For example, in cases where the other structures in the structure mixture are ferrite and pearlite, the steel exhibits a lowered tensile strength. In cases where the other structures are martensite and austenite, the steel exhibits an increased tensile strength and a lowered toughness.

EXAMPLES

Molten steels having various compositions as shown in Tables 1, 2, 3 and 4 were prepared in a 150-kg vacuum melting furnaces, and molded each to form a steel ingot 40 mm thick which was used as a steel material. These steel materials were heated at 1475K for 1200 sec, and then immediately forged in a working ratio of 50%, and allowed to cool. Part of the as-cooled steel materials were further aged at 570 or 830K for 30 minutes. The as-cooled steel materials and the aged steel materials were subjected to tensile tests and impact tests. The tensile test pieces were of JIS No. 4 type, and the impact test pieces were of JIS No. 3 type.

TABLE 1

| No. | Steel | Claims | C | Si | Mn | Cr | S | V | N | Mo | Nb | Al, Ti | Ceq. (%) | Bs (K) |
|---|---|---|---|---|---|---|---|---|---|---|---|---|---|---|
| 1 | S.I. | 1,5,9 | 0.17 | 1.58 | 2.00 | 0.47 | 0.056 | 0.255 | 0.0116 | — | — | — | 0.87 | 796 |
| 2 | S.I. | 1,5,9 | 0.26 | 1.49 | 1.92 | 0.35 | 0.059 | 0.180 | 0.0120 | — | — | — | 0.89 | 765 |
| 3 | S.I. | 1,5,9 | 0.40 | 1.48 | 1.83 | 0.12 | 0.057 | 0.144 | 0.0116 | — | — | — | 0.95 | 703 |
| 4 | C.S. | 1,5,9 | 0.10 | 1.00 | 2.02 | 0.87 | 0.058 | 0.150 | 0.0114 | — | — | — | 0.80 | 844 |
| 5 | C.S. | 1,5,9 | 0.56 | 0.97 | 1.88 | 0.06 | 0.057 | 0.162 | 0.0081 | — | — | — | 1.06 | 614 |
| 6 | S.I. | 1,5,9 | 0.31 | 0.95 | 1.94 | 0.40 | 0.051 | 0.194 | 0.0083 | — | — | — | 0.90 | 742 |
| 7 | S.I. | 1,5,9 | 0.30 | 2.03 | 1.90 | 0.47 | 0.050 | 0.162 | 0.0099 | — | — | — | 1.00 | 724 |
| 8 | S.I. | 1,5,9 | 0.25 | 2.92 | 1.86 | 0.21 | 0.063 | 0.150 | 0.0103 | — | — | — | 0.97 | 752 |
| 9 | C.S. | 1,5,9 | 0.30 | 0.25 | 1.99 | 0.49 | 0.061 | 0.177 | 0.0108 | — | — | — | 0.83 | 767 |
| 10 | C.S. | 1,5,9 | 0.16 | 3.21 | 1.53 | 0.33 | 0.052 | 0.062 | 0.0093 | — | — | — | 0.85 | 830 |
| 11 | S.I. | 1,5,9 | 0.30 | 1.55 | 1.25 | 0.50 | 0.090 | 0.251 | 0.0174 | — | — | — | 0.87 | 772 |
| 12 | S.I. | 1,5,9 | 0.29 | 1.62 | 2.03 | 0.29 | 0.091 | 0.140 | 0.0136 | — | — | — | 0.93 | 743 |
| 13 | S.I. | 1,5,9 | 0.30 | 1.61 | 2.30 | 0.35 | 0.080 | 0.156 | 0.0121 | — | — | — | 1.00 | 712 |
| 14 | S.I. | 1,5,9 | 0.35 | 1.27 | 2.94 | 0.42 | 0.095 | 0.141 | 0.0100 | — | — | — | 1.14 | 639 |
| 15 | C.S. | 1,5,9 | 0.33 | 1.30 | 0.85 | 0.35 | 0.083 | 0.150 | 0.0112 | — | — | — | 0.74 | 812 |
| 16 | C.S. | 1,5,9 | 0.28 | 1.06 | 3.24 | 0.27 | 0.082 | 0.073 | 0.0121 | — | — | — | 1.05 | 681 |
| 17 | S.I. | 1,5,9 | 0.25 | 1.25 | 2.07 | 0.37 | 0.042 | 0.148 | 0.0100 | — | — | — | 0.88 | 769 |
| 18 | C.S. | 1,5,9 | 0.25 | 1.22 | 1.98 | 0.38 | 0.011 | 0.102 | 0.0128 | — | — | — | 0.84 | 782 |
| 19 | C.S. | 1,5,9 | 0.26 | 1.22 | 1.99 | 0.39 | 0.211 | 0.101 | 0.0114 | — | — | — | 0.86 | 775 |
| 20 | S.I. | 1,5,9 | 0.40 | 1.45 | 2.02 | 0.35 | 0.032 | 0.052 | 0.0140 | — | — | — | 1.00 | 689 |
| 21 | S.I. | 1,5,9 | 0.23 | 1.03 | 2.00 | 0.35 | 0.035 | 0.470 | 0.0142 | — | — | — | 0.92 | 752 |
| 22 | C.S. | 1,5,9 | 0.39 | 1.00 | 2.03 | 0.43 | 0.034 | 0.009 | 0.0150 | — | — | — | 0.95 | 706 |
| 23 | C.S. | 1,5,9 | 0.18 | 0.99 | 1.86 | 0.42 | 0.035 | 0.600 | 0.0112 | — | — | — | 0.90 | 775 |
| 24 | S.I. | 1,5,9 | 0.24 | 1.19 | 2.21 | 0.32 | 0.039 | 0.124 | 0.0088 | — | — | — | 0.87 | 772 |
| 25 | S.I. | 1,5,9 | 0.25 | 1.20 | 2.25 | 0.35 | 0.045 | 0.122 | 0.0197 | — | — | — | 0.89 | 760 |
| 26 | C.S. | 1,5,9 | 0.25 | 1.20 | 2.07 | 0.37 | 0.039 | 0.119 | 0.0045 | — | — | — | 0.86 | 774 |
| 27 | C.S. | 1,5,9 | 0.26 | 1.18 | 2.02 | 0.38 | 0.050 | 0.122 | 0.0289 | — | — | — | 0.86 | 770 |

TABLE 2

| No. | Steel | Claims | C | Si | Mn | Cr | S | V | N | Mo | Nb | Al, Ti | Ceq. (%) | Bs (K) |
|---|---|---|---|---|---|---|---|---|---|---|---|---|---|---|
| 28 | S.I. | 2,6,9 | 0.22 | 1.55 | 2.00 | 0.32 | 0.065 | 0.158 | 0.0122 | — | — | Al: 0.032 | 0.86 | 787 |
| 29 | C.S. | 2,6,9 | 0.32 | 2.15 | 1.97 | 0.50 | 0.046 | 0.067 | 0.0107 | — | — | Al: 0.096 | 1.02 | 714 |
| 30 | S.I. | 2,6,9 | 0.24 | 2.44 | 1.75 | 0.48 | 0.043 | 0.067 | 0.0144 | — | — | Ti: 0.042 | 0.93 | 774 |
| 31 | C.S. | 2,6,9 | 0.24 | 2.35 | 1.70 | 0.26 | 0.050 | 0.077 | 0.0157 | — | — | Ti: 0.102 | 0.86 | 791 |
| 32 | S.I. | 2,6,9 | 0.27 | 1.40 | 2.23 | 0.26 | 0.033 | 0.106 | 0.0159 | — | — | Al: 0.010<br>Ti: 0.010 | 0.90 | 752 |
| 33 | S.I. | 3,7,9 | 0.39 | 1.10 | 1.81 | 0.49 | 0.032 | 0.124 | 0.0133 | 0.07 | — | — | 1.01 | 698 |
| 34 | S.I. | 3,7,9 | 0.24 | 1.02 | 2.25 | 0.32 | 0.040 | 0.126 | 0.0120 | 0.45 | — | — | 0.96 | 743 |
| 35 | S.I. | 3,7,9 | 0.18 | 1.54 | 2.55 | 0.12 | 0.041 | 0.116 | 0.0100 | 0.94 | — | — | 1.01 | 722 |
| 36 | C.S. | 3,7,9 | 0.20 | 1.24 | 2.04 | 0.30 | 0.042 | 0.064 | 0.0168 | 1.48 | — | — | 0.97 | 716 |
| 37 | S.I. | 3,7,9 | 0.25 | 1.56 | 1.71 | 0.44 | 0.049 | 0.072 | 0.0151 | — | 0.014 | — | 0.84 | 792 |
| 38 | S.I. | 3,7,9 | 0.25 | 1.54 | 1.76 | 0.50 | 0.040 | 0.071 | 0.0154 | — | 0.140 | — | 0.90 | 770 |
| 39 | S.I. | 3,7,9 | 0.19 | 1.55 | 1.76 | 0.45 | 0.043 | 0.026 | 0.0153 | — | 0.476 | — | 0.92 | 773 |
| 40 | C.S. | 3,7,9 | 0.26 | 1.60 | 2.10 | 0.19 | 0.031 | 0.067 | 0.0134 | — | 0.556 | — | 1.04 | 701 |
| 41 | S.I. | 3,7,9 | 0.26 | 1.53 | 1.80 | 0.23 | 0.031 | 0.055 | 0.0113 | 0.94 | 0.014 | — | 0.96 | 730 |

TABLE 2-continued

| | | | | | | | | | | | | | | |
|---|---|---|---|---|---|---|---|---|---|---|---|---|---|---|
| 42 | S.I. | 4,8,9 | 0.32 | 2.02 | 1.92 | 0.13 | 0.036 | 0.076 | 0.0116 | 0.09 | — | Al: 0.007 | 0.97 | 735 |
| 43 | S.I. | 4,8,9 | 0.24 | 2.50 | 1.94 | 0.44 | 0.043 | 0.052 | 0.0155 | 0.31 | — | Ti: 0.005 | 1.04 | 742 |
| 44 | S.I. | 4,8,9 | 0.26 | 1.46 | 2.28 | 0.17 | 0.037 | 0.101 | 0.0119 | — | 0.154 | Al: 0.022 | 0.94 | 739 |
| 45 | S.I. | 4,8,9 | 0.24 | 1.48 | 1.97 | 0.20 | 0.048 | 0.105 | 0.0103 | — | 0.103 | Ti: 0.015 | 0.85 | 779 |
| 46 | S.I. | 4,8,9 | 0.22 | 1.44 | 2.07 | 0.35 | 0.032 | 0.094 | 0.0114 | 0.23 | 0.123 | Al: 0.029 | 0.96 | 760 |
| 47 | S.I. | 4,8,9 | 0.22 | 1.32 | 1.95 | 0.19 | 0.051 | 0.100 | 0.0102 | 0.20 | — | Al: 0.032<br>Ti: 0.017 | 0.85 | 798 |
| 48 | S.I. | 4,8,9 | 0.26 | 1.55 | 2.02 | 0.17 | 0.041 | 0.110 | 0.0136 | 0.26 | 0.206 | Al: 0.012<br>Ti: 0.014 | 1.00 | 771 |

Note:
S.I. = Steel of invention
C.S. = Comparative steel
Steel No. 15 had a ferrite-pearlite structure.
Steel Nos 7, 8, 29, 30, 31 and 42 contained from 6 to 9% of a ferrtie structure.
Steel No. 14 contained 10% of a martensite structure.
Steels (as-cooled or aged at 570 K.) excluding Steel No. 15 contained from 1 to 14% of an austenite structure.

TABLE 3

| | | | As-cooled | | | Aging at 570 K. | | |
|---|---|---|---|---|---|---|---|---|
| No. | Steel | Claims | T.S. (MPa) | Y.P. | uE (J/cm$^2$) | T.S. (MPa) | Y.P. | uE (J/cm$^2$) |
| 1 | S.I. | 1,5,9 | 1060 | 0.64 | 79 | 1040 | 0.81 | 86 |
| 2 | S.I. | 1,5,9 | 1076 | 0.64 | 82 | 1061 | 0.79 | 83 |
| 3 | S.I. | 1,5,9 | 1139 | 0.63 | 72 | 1130 | 0.79 | 74 |
| 4 | C.S. | 1,5,9 | 982 | 0.62 | 45 | 964 | 0.98 | 43 |
| 5 | C.S. | 1,5,9 | 1255 | 0.62 | 34 | 1253 | 0.80 | 33 |
| 6 | S.I. | 1,5,9 | 1084 | 0.62 | 71 | 1078 | 0.80 | 64 |
| 7 | S.I. | 1,5,9 | 1195 | 0.64 | 82 | 1185 | 0.80 | 85 |
| 8 | S.I. | 1,5,9 | 1147 | 0.64 | 76 | 1157 | 0.81 | 85 |
| 9 | C.S. | 1,5,9 | 1011 | 0.66 | 44 | 1006 | 0.82 | 47 |
| 10 | C.S. | 1,5,9 | 1024 | 0.63 | 42 | 1015 | 0.82 | 45 |
| 11 | S.I. | 1,5,9 | 1047 | 0.62 | 81 | 1052 | 0.82 | 80 |
| 12 | S.I. | 1,5,9 | 1110 | 0.64 | 79 | 1099 | 0.80 | 78 |
| 13 | S.I. | 1,5,9 | 1181 | 0.66 | 79 | 1185 | 0.80 | 74 |
| 14 | S.I. | 1,5,9 | 1326 | 0.65 | 70 | 1332 | 0.81 | 69 |
| 15 | C.S. | 1,5,9 | 905 | 0.64 | 56 | 900 | 0.82 | 50 |
| 16 | C.S. | 1,5,9 | 1229 | 0.63 | 48 | 1242 | 0.80 | 50 |
| 17 | S.I. | 1,5,9 | 1052 | 0.65 | 74 | 1043 | 0.79 | 71 |
| 18 | C.S. | 1,5,9 | 1017 | 0.62 | 55 | 1018 | 0.81 | 58 |
| 19 | C.S. | 1,5,9 | 1027 | 0.65 | 23 | 1023 | 0.80 | 30 |
| 20 | S.I. | 1,5,9 | 1178 | 0.66 | 76 | 1179 | 0.81 | 73 |
| 21 | S.I. | 1,5,9 | 1109 | 0.64 | 63 | 1100 | 0.79 | 57 |
| 22 | C.S. | 1,5,9 | 1127 | 0.64 | 44 | 1121 | 0.80 | 51 |
| 23 | C.S. | 1,5,9 | 1075 | 0.62 | 43 | 1076 | 0.80 | 54 |
| 24 | S.I. | 1,5,9 | 1044 | 0.64 | 76 | 1041 | 0.79 | 70 |
| 25 | S.I. | 1,5,9 | 1066 | 0.61 | 78 | 1065 | 0.80 | 78 |
| 26 | C.S. | 1,5,9 | 1050 | 0.64 | 40 | 1030 | 0.79 | 38 |
| 27 | C.S. | 1,5,9 | 1047 | 0.62 | 61 | 1031 | 0.81 | 59 |

| | | | Aging at 830 K. | | | |
|---|---|---|---|---|---|---|
| No. | Steel | Claims | T.S. (MPa) | Y.P. | uE (J/cm$^2$) | Comparative components |
| 1 | S.I. | 1,5,9 | 1063 | 0.82 | 69 | C, Cr |
| 2 | S.I. | 1,5,9 | 1043 | 0.82 | 67 | C, Cr |
| 3 | S.I. | 1,5,9 | 1084 | 0.81 | 65 | C, Cr |
| 4 | C.S. | 1,5,9 | 930 | 0.80 | 39 | C, Cr |
| 5 | C.S. | 1,5,9 | 1179 | 0.81 | 26 | C, Cr |
| 6 | S.I. | 1,5,9 | 1043 | 0.82 | 55 | Si |
| 7 | S.I. | 1,5,9 | 1165 | 0.83 | 74 | Si |
| 8 | S.I. | 1,5,9 | 1164 | 0.81 | 64 | Si |
| 9 | C.S. | 1,5,9 | 937 | 0.80 | 32 | Si |
| 10 | C.S. | 1,5,9 | 1022 | 0.80 | 33 | Si |
| 11 | S.I. | 1,5,9 | 1065 | 0.81 | 72 | Mn |
| 12 | S.I. | 1,5,9 | 1064 | 0.81 | 73 | Mn |
| 13 | S.I. | 1,5,9 | 1143 | 0.80 | 70 | Mn |
| 14 | S.I. | 1,5,9 | 1256 | 0.81 | 55 | Mn |
| 15 | C.S. | 1,5,9 | 885 | 0.81 | 63 | Mn |
| 16 | C.S. | 1,5,9 | 1125 | 0.82 | 55 | Mn |
| 17 | S.I. | 1,5,9 | 1006 | 0.98 | 62 | S |

TABLE 3-continued

| | | | | | | |
|---|---|---|---|---|---|---|
| 18 | C.S. | 1,5,9 | 954 | 0.82 | 41 | S |
| 19 | C.S. | 1,5,9 | 967 | 0.82 | 27 | S |
| 20 | S.I. | 1,5,9 | 1094 | 0.83 | 66 | V |
| 21 | S.I. | 115,9 | 1181 | 0.81 | 55 | V |
| 22 | C.S. | 1,5,9 | 1010 | 0.81 | 63 | V |
| 23 | C.S. | 1,5,9 | 1216 | 0.82 | 54 | V |
| 24 | S.I. | 1,5,9 | 992 | 0.81 | 71 | N |
| 25 | S.I. | 1,5,9 | 1005 | 0.81 | 64 | N |
| 26 | C.S. | 1,5,9 | 977 | 0.82 | 50 | N |
| 27 | C.S. | 1,5,9 | 980 | 0.81 | 69 | N |

TABLE 4

| | | | As-cooled | | | Aging at 570 K. | | |
|---|---|---|---|---|---|---|---|---|
| No. | Steel | Claims | T.S. (MPa) | Y.P. | uE (J/cm$^2$) | (MPa) | Y.P. (J/cm$^2$) | uE (J/cm$^2$) |
| 28 | S.I. | 2,6,9 | 1034 | 0.65 | 68 | 1020 | 0.81 | 67 |
| 29 | S.I. | 2,6,9 | 1212 | 0.63 | 35 | 1194 | 0.82 | 35 |
| 30 | S.I. | 2,6,9 | 1103 | 0.68 | 96 | 1103 | 0.80 | 97 |
| 31 | C.S. | 2,6,9 | 1043 | 0.66 | 35 | 1043 | 0.80 | 28 |
| 32 | S.I. | 2,6,9 | 1086 | 0.65 | 76 | 1073 | 0.80 | 80 |
| 33 | S.I. | 3,7,9 | 1197 | 0.65 | 66 | 1194 | 0.81 | 68 |
| 34 | S.I. | 3,7,9 | 1139 | 0.62 | 72 | 1148 | 0.80 | 66 |
| 35 | S.I. | 3,7,9 | 1196 | 0.64 | 74 | 1182 | 0.91 | 72 |
| 36 | C.S. | 3,7,9 | 1149 | 0.64 | 70 | 1149 | 0.82 | 68 |
| 37 | S.I. | 3,7,9 | 1011 | 0.63 | 81 | 1017 | 0.80 | 80 |
| 38 | S.I. | 3,7,9 | 1087 | 0.64 | 81 | 1064 | 0.82 | 81 |
| 39 | S.I. | 3,7,9 | 1102 | 0.65 | 83 | 1102 | 0.79 | 77 |
| 40 | C.S. | 3,7,9 | 1226 | 0.63 | 53 | 1227 | 0.81 | 33 |
| 41 | S.I. | 3,7,9 | 1134 | 0.63 | 78 | 1135 | 0.81 | 77 |
| 42 | S.I. | 4,8,9 | 1159 | 0.63 | 86 | 1153 | 0.80 | 92 |
| 43 | S.I. | 4,8,9 | 1218 | 0.64 | 97 | 1219 | 0.80 | 91 |
| 44 | S.I. | 4,8,9 | 1117 | 0.64 | 73 | 1109 | 0.81 | 79 |
| 45 | S.I. | 4,8,9 | 1023 | 0.62 | 81 | 1033 | 0.80 | 81 |
| 46 | S.I. | 4,8,9 | 1144 | 0.62 | 75 | 1145 | 0.80 | 74 |
| 47 | S.I. | 4,8,9 | 1015 | 0.64 | 82 | 1011 | 0.82 | 82 |
| 48 | S.I. | 4,8,9 | 1186 | 0.64 | 74 | 1170 | 0.82 | 72 |

| | | | Aging at 830 K. | | | |
|---|---|---|---|---|---|---|
| No. | Steel | Claims | T.S. (MPa) | Y.P. | uE (J/cm$^2$) | Comparative components |
| 28 | S.I. | 2,6,9 | 1002 | 0.82 | 77 | Al, Ti |
| 29 | S.I. | 2,6,9 | 1147 | 0.81 | 32 | Al, Ti |
| 30 | S.I. | 2,6,9 | 1069 | 0.81 | 84 | Al, Ti |
| 31 | C.S. | 2,6,9 | 1006 | 0.82 | 40 | Al, Ti |
| 32 | S.I. | 2,6,9 | 1016 | 0.82 | 65 | Al, Ti |
| 33 | S.I. | 3,7,9 | 1177 | 0.82 | 58 | Mo, Nb |
| 34 | S.I. | 3,7,9 | 1196 | 0.82 | 55 | Mo, Nb |
| 35 | S.I. | 3,7,9 | 1309 | 0.83 | 58 | Mo, Nb |

TABLE 4-continued

| | | | | | | |
|---|---|---|---|---|---|---|
| 36 | C.S. | 3,7,9 | 1288 | 0.82 | 61 | Mo, Nb |
| 37 | S.I. | 3,7,9 | 957 | 0.83 | 73 | Mo, Nb |
| 38 | S.I. | 3,7,9 | 1069 | 0.81 | 67 | Mo, Nb |
| 39 | S.I. | 3,7,9 | 1219 | 0.83 | 68 | Mo, Nb |
| 40 | C.S. | 3,7,9 | 1382 | 0.83 | 21 | Mo, Nb |
| 41 | S.I. | 3,7,9 | 1249 | 0.83 | 61 | Mo, Nb |
| 42 | S.I. | 4,8,9 | 1149 | 0.82 | 76 | Al, Ti, Nb, Mo |
| 43 | S.I. | 4,8,9 | 1277 | 0.81 | 83 | Al, Ti, Nb, Mo |
| 44 | S.I. | 4,8,9 | 1114 | 0.81 | 69 | Al, Ti, Nb, Mo |
| 45 | S.I. | 4,8,9 | 1017 | 0.82 | 70 | Al, Ti, Nb, Mo |
| 46 | S.I. | 4,8,9 | 1213 | 0.83 | 59 | Al, Ti, Nb, Mo |
| 47 | S.I. | 4,8,9 | 1044 | 0.80 | 68 | Al, Ti, Nb, Mo |
| 48 | S.I. | 4,8,9 | 1304 | 0.80 | 63 | Al, Ti, Nb, Mo |

Note:
S.I. = Steel of invention
C.S. = Comparative steel

As shown in Tables 1, 2, 3 and 4, a steel (in a non-normalized state) prepared by forging a steel of the invention and allowing it to cool has a high tensile strength of at least 1,000 MPa and a good impact value of at least 55 J/cm$^2$. Moreover, a steel prepared by forging the steel of the invention, allowing it to cool and aging it has a significantly improved yield ratio.

POSSIBILITY OF UTILIZING THE INVENTION IN THE INDUSTRY

As illustrated above, the steels of the present invention according to claims 1, 2, 3 and 4 are optimum as materials for hot forged and non-quenched and tempered steel parts having a tensile strength of at least 1,000 MPa and a high toughness. A microalloyed hot forging having a tensile strength of at least 1,000 MPa and a high toughness and a microalloyed hot forging having a tensile strength of at least 1,000 MPa, a high yield ratio and a high toughness can be produced by the processes of the present invention according to claims 5, 6, 7 and 8.

Furthermore, since the microalloyed hot forging of the present invention according to claim 9 has a tensile strength of at least 1,000 MPa, it can be designed in a small size when it is used as parts of automobiles or industrial machines. Accordingly, the hot forging of the invention can contribute to lighten vehicles and reduce fuel consumption.

We claim:

1. A microalloyed steel for hot forging comprising, in terms of percentage by weight, from 0.15 to 0.40% of C, from 0.90 to 3.00% of Si, from 1.20 to 3.00% of Mn, from 0.10 to 0.50% of Cr, from 0.03 to 0.10% of S, from 0.05 to 0.50% of V, from 0.0080 to 0.0200% of N and the balance Fe and unavoidable impurities, having a carbon equivalent (Ceq.) represented by the formula $$\text{Ceq. }(\%)=C+0.10\ (\%Si)+0.18\ (\%Mn)+0.21\ (\%Cr)+0.328\ (\%V)$$

of at least 0.82%, and exhibiting a bainite transformation starting point Bs represented by the formula $$BS\ (K)=1152-618\ (\%C)-25\ (\%Si)-76\ (\%Mn)-55\ (\%Cr)-127\ (\%V)$$

of up to 810K;

said microalloyed steel having a bainitic structure and having a tensile strength of 1000 MPa or more without quenching and tempering.

2. A microalloyed steel for hot forging according to claim 1, wherein said steel further comprises one or two selected from the group of from 0.005 to 0.050% of Al and from 0.002 to 0.050% of Ti.

3. A microalloyed steel for hot forging further comprising one or two selected from the group of from 0.05 to 1.00% of Mo and from 0.01 to 0.50% of Nb in addition to the components according to claim 1 and the balance Fe and unavoidable impurities, having a carbon equivalent (Ceq.) represented by the formula $$\text{Ceq. }(\%)=C+0.10\ (\%Si)+0.18\ (\%Mn)+0.21\ (\%Cr)+0.155\ (\%Mo)^{1/2}+0.328\ (\%V+\%Nb)$$

of at least 0.82%, and exhibiting a bainite transformation starting point Bs represented by the formula $$Bs\ (K)=1152-618\ (\%C)-25\ (\%Si)-76\ (\%Mn)-55\ (\%Cr)-69\ (\%Mo)-127\ (\%V+\%Nb)$$

of up to 810K.

4. The microalloyed steel for hot forging according to claim 3, wherein said steel further comprises one or two selected from the group of from 0.005 to 0.050% of Al and from 0.002 to 0.050% of Ti.

5. A process for producing a microalloyed hot forging comprising the steps of;

working a microalloyed steel for hot forging which comprises, in terms of percentage by weight, from 0.15 to 0.40% of C, from 0.90 to 3.00% of Si, from 1.20 to 3.00% of Mn, from 0.10 to 0.50% of Cr, from 0.03 to 0.10% of S, from 0.05 to 0.50% of V from 0.0080 to 0.0200% of N and the balance Fe and unavoidable impurities, which has a carbon equivalent (Ceq.) represented by the formula $$\text{Ceq. }(\%)=C+0.10\ (\%Si)+0.18\ (\%Mn)+0.21\ (\%Cr)+0.328\ (\%V)$$

of at least 0.82%, and which exhibits a bainite transformation starting point Bs represented by the formula $$BS\ (K)=1152-618\ (\%C)-25\ (\%Si)-76\ (\%Mn)-55\ (\%Cr)-127\ (\%V)$$

of up to 810K, and working said microalloyed steel at a temperature of at least 1270K, allowing the worked product to cool in air, or, after working at a temperature of at least 1270K and allowing the worked product to cool in air, further aging the cooled product at a temperature of 450 to 900K, thereby providing microalloyed steel having a bainitic structure and having a tensile strength of 1000 MPa or more without quenching and tempering.

6. A process for producing a microalloyed hot forging comprising the steps of;

working a microalloyed steel for hot forging according to claim 5 which further comprises one or two selected from the group of from 0.005 to 0.050% of Al and from 0.002 to 0.050% of Ti, at a temperature of at least 1270K and allowing the worked product to cool in air, or, after working said microalloyed steel at a temperature of at least 1270K and allowing the worked product to cool in air, further aging the cooled product at a temperature of 450 to 900K.

7. A process for producing a microalloyed hot forging comprising the steps of;

working a microalloyed steel for hot forging which further comprises one or two selected from the group of from 0.05 to 1.00% of Mo and from 0.01 to 0.50% of Nb in addition to the components according to claim 5 and the balance Fe and unavoidable impurities, which has a carbon equivalent (Ceq.) represented by the formula $$Ceq.\ (\%)=C+0.10\ (\%Si)+0.18\ (\%Mn)+0.21\ (\%Cr)+0.155\ (\%Mo)^{1/2}+0.328\ (\%V+\%Nb)$$

of at least 0.82%, and which exhibits a bainite transformation starting point Bs represented by the formula $$Bs\ (K)=1152-618\ (\%C)-25\ (\%Si)-76\ (\%Mn)-55\ (\%Cr)-69\ (\%Mo)-127\ (\%V+\%Nb)$$

of up to 810K, and working said microalloyed steel at a temperature of at least 1270K, allowing the worked product to cool in air, or, after working at a temperature of at least 1270K and allowing the worked product to cool in air, further aging the cooled product at a temperature of 450 to 900K.

8. A process for producing a microalloyed hot forging comprising the steps of;

working a microalloyed steel for hot forging which further comprises one or two selected from the group of from 0.005 to 0.050% of Al and from 0.002 to 0.050% of Ti in addition to the components according to claim 7, at a temperature of at least 1270K and allowing the worked product to cool in air, or, after working said microalloyed steel at a temperature of at least 1270K and allowing the worked product to cool in air, further aging the cooled product at a temperature of 450 to 900K.

9. A microalloyed hot forging comprising the components according to claim 1, having a bainite structure in a volume of at least 80%, and exhibiting a tensile strength of at least 1,000 MPa.

* * * * *

UNITED STATES PATENT AND TRADEMARK OFFICE

CERTIFICATE OF CORRECTION

PATENT NO. : 5,660,648

DATED : August 26, 1997

INVENTOR(S) : Hiromasa TAKADA, et al.

It is certified that error appears in the above-indentified patent and that said Letters Patent is hereby corrected as shown below:

Column 1, line 67, delete "a".

Column 2, line 40, at end of line change "...)$^{1/}$" to --...)$^{1/2}$--.

Column 2, line 42, delete "2" at beginning of line.

Column 3, line 37, at end of line change "...)$^{1/}$" to --...)$^{1/2}$--.

Column 3, line 38, delete "2" at beginning of line.

Column 4, line 38, change "facet" to --facets--.

Column 6, line 32, at end of line change "...)$^{1/}$" to --...)$^{1/2}$--.

Column 6, line 33, delete "2" at beginning of line.

Column 8, line 12, change "furnaces" to --furnace--.

Column 8, Table 1, under column headed "Bs(K)", change "689" to --688--.

UNITED STATES PATENT AND TRADEMARK OFFICE

CERTIFICATE OF CORRECTION

PATENT NO. : 5,660,648
DATED : August 26, 1997
INVENTOR(S) : Hiromasa TAKADA, et al.

It is certified that error appears in the above-indentified patent and that said Letters Patent is hereby corrected as shown below:

Column 9, Table 2, fourth line under "Note:", change "ferrtie" to --ferrite--.

Column 10, Table 3, fourth line down, change "115.9" to --1,5,9--.

Column 10, Table 4, heading of next to last column should be --T.S. (MPa) Y.P.--.

Column 10, Table 4, next to last column, eigth line down, change "0.91" to --0.81--.

Column 12, line 13, at end of line change "...)$^{1/}$" to --...)$^{1/2}$--.

Column 12, line 14, delete "2" at beginning of line.

Column 12, line 34, after "V" insert a comma.

UNITED STATES PATENT AND TRADEMARK OFFICE

CERTIFICATE OF CORRECTION

PATENT NO. : 5,660,648

DATED : August 26, 1997

INVENTOR(S) : Hiromasa TAKADA, et al.

It is certified that error appears in the above-indentified patent and that said Letters Patent is hereby corrected as shown below:

Column 13, line 14, at end of line change "...)$^{1/}$" to --...)$^{1/2}$--.

Column 13, line 15, delete "2" at beginning of line.

Signed and Sealed this

Thirtieth Day of June, 1998

*Attest:*

*Attesting Officer*

Bruce Lehman

BRUCE LEHMAN

*Commissioner of Patents and Trademarks*